US010934084B2

(12) United States Patent
Cox

(10) Patent No.: US 10,934,084 B2
(45) Date of Patent: Mar. 2, 2021

(54) APPLIANCE CONTAINMENT DEVICE

(71) Applicant: Daniel Cox, Round Lake, FL (US)

(72) Inventor: Daniel Cox, Round Lake, FL (US)

( * ) Notice: Subject to any disclaimer, the term of this patent is extended or adjusted under 35 U.S.C. 154(b) by 0 days.

(21) Appl. No.: 16/727,025

(22) Filed: Dec. 26, 2019

(65) Prior Publication Data

US 2020/0317433 A1 Oct. 8, 2020

Related U.S. Application Data

(63) Continuation-in-part of application No. 16/375,203, filed on Apr. 4, 2019, now abandoned.

(51) Int. Cl.

| | |
|---|---|
| ***B65D 85/00*** | (2006.01) |
| ***B65D 85/68*** | (2006.01) |
| ***B65D 25/28*** | (2006.01) |
| ***B65D 25/14*** | (2006.01) |

(52) U.S. Cl.

CPC ..... *B65D 85/68* (2013.01); *B65D 25/14* (2013.01); *B65D 25/2835* (2013.01); *B65D 2585/6857* (2013.01)

(58) Field of Classification Search

CPC .... B65D 85/68; B65D 25/14; B65D 25/2535; B65D 2585/6857

USPC ..... 383/108

See application file for complete search history.

(56) References Cited

U.S. PATENT DOCUMENTS

| | | | | |
|---|---|---|---|---|
| 2,932,438 A * | 4/1960 | Smith | B65D 5/12 | 206/320 |
| 4,039,098 A * | 8/1977 | Stilts | F24H 1/182 | 220/694.1 |
| 4,445,230 A * | 4/1984 | Spadaro | B65D 33/1608 | 383/26 |
| 4,844,286 A * | 7/1989 | Jacobson | B65D 77/003 | 220/694 |
| 5,190,089 A * | 3/1993 | Jackson | D06F 39/001 | 150/165 |
| 5,862,911 A * | 1/1999 | Phillips, II | B65D 75/004 | 206/320 |
| 5,865,223 A * | 2/1999 | Cornford | B65D 90/24 | 137/312 |
| 6,027,248 A * | 2/2000 | Nelson | B65F 1/0006 | 383/113 |
| 6,276,309 B1 * | 8/2001 | Zeek | F24H 9/165 | 122/504 |
| 7,493,877 B2 * | 2/2009 | Broadway | F24H 9/02 | 122/19.2 |

(Continued)

*Primary Examiner* — Peter N Helvey

(74) *Attorney, Agent, or Firm* — Patentfile, LLC; Bradley C. Fach; Steven R. Kick

(57) ABSTRACT

An appliance containment device may include a shell having a shell floor and a shell wall, and a cover having a cover floor and a cover wall. The cover wall and shell wall may be coupled together. A first mat may be coupled to the cover floor. A container cavity for receiving portions of an appliance may be formed above the cover floor and shell floor, and the cavity may be bounded horizontally by the shell wall and cover wall. Lower portions of an appliance may be positioned in the container cavity. Optionally, the device may include an encasement which may be positioned around the upper portions of the appliance with lower portions of the encasement extending into the container cavity, thereby allowing the device to encase the appliance within the shell, cover, and encasement.

20 Claims, 13 Drawing Sheets

(56) References Cited

U.S. PATENT DOCUMENTS

| | | | | |
|---|---|---|---|---|
| 10,427,874 | B1 * | 10/2019 | Hurd | B65D 33/06 |
| 2009/0169136 | A1 * | 7/2009 | Kenney | F24H 1/06<br>383/105 |

* cited by examiner

APPLIANCE CONTAINMENT DEVICE

CROSS REFERENCE TO RELATED APPLICATIONS

This application is a continuation-in-part of U.S. Non-Provisional application Ser. No. 16/375,203, filed on Apr. 4, 2019, entitled "APPLIANCE CONTAINMENT DEVICE", which is hereby incorporated by reference in its entirety.

FIELD OF THE INVENTION

This patent specification relates to the field of containment devices. More specifically, this patent specification relates to a device that is configured to enclose portions of an appliance or other object to contain dirt, water, and other contaminants that the appliance may release.

BACKGROUND

Appliances, such as water heaters, by the nature of the task they are designed to accomplish, become dirty through use and often leak water, dirt, and other contaminants when moved. This makes the removal of the appliances a cumbersome task as care must be taken to prevent or minimize the leakage of these contaminants onto people and surfaces.

In order to facilitate the removal of appliances, people may resort to wearing gloves and wrapping the appliance in drop cloths, trash bags, or plastic tarps. Unfortunately, these methods have many drawbacks. Once gloves come in contact with a dirty surface, anything they come in contact afterwards will become contaminated as well. While drop cloths may be wrapped around and completely cover the appliance, any liquid will quickly seep through and leak onto floor surfaces, which may then be spread by the shoes of people carrying the appliance. The drop cloth must then be washed or thrown away resulting in increased costs and inconvenience. Plastic tarps may be wrapped around the appliance but they are difficult to maintain in position around the appliance. Also, like drop cloths, plastic tarps are prone to leaks, and they must be washed or thrown away after each use. Additionally, these tarps and the like may rip and tear thereby allowing the contaminants to leak out.

Therefore, a need exists for novel appliance containment devices. A further need exists for appliance containment devices device which are able to enclose portions of an appliance or other object to contain dirt, water, and other contaminants that the appliance may release. There is also a need for appliance containment devices which are able to be secured to an appliance in order to ensure appliance containment during transit. Finally, there is a need for appliance containment devices which are able to accommodate a wide range of appliance sizes and designs.

BRIEF SUMMARY OF THE INVENTION

An appliance containment device is provided. The device may be used to facilitate the transport of an appliance, such as a water heater, preferably by being configured to enclose portions of the appliance to contain dirt, water, and other contaminants that the appliance may release and also to facilitate movement of the appliance.

In some embodiments, the device may include a shell having a shell floor and a shell wall, and a cover having a cover floor and a cover wall. The cover wall and shell wall may be coupled together. A first mat may be coupled to the cover floor. A container cavity for receiving portions of an appliance may be formed above the cover floor and shell floor, and the container cavity may be bounded horizontally by the shell wall and cover wall. Lower portions of an appliance may be positioned in the container cavity.

In further embodiments, the device may include an encasement which may be positioned around the upper portions of the appliance with lower portions of the encasement extending into the cavity, thereby allowing the device to encase the appliance within the shell, cover, and encasement.

In still further embodiments, the device may include a handle which may be coupled to the shell wall.

In still further embodiments, the first mat may be positioned between the shell floor and cover floor.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
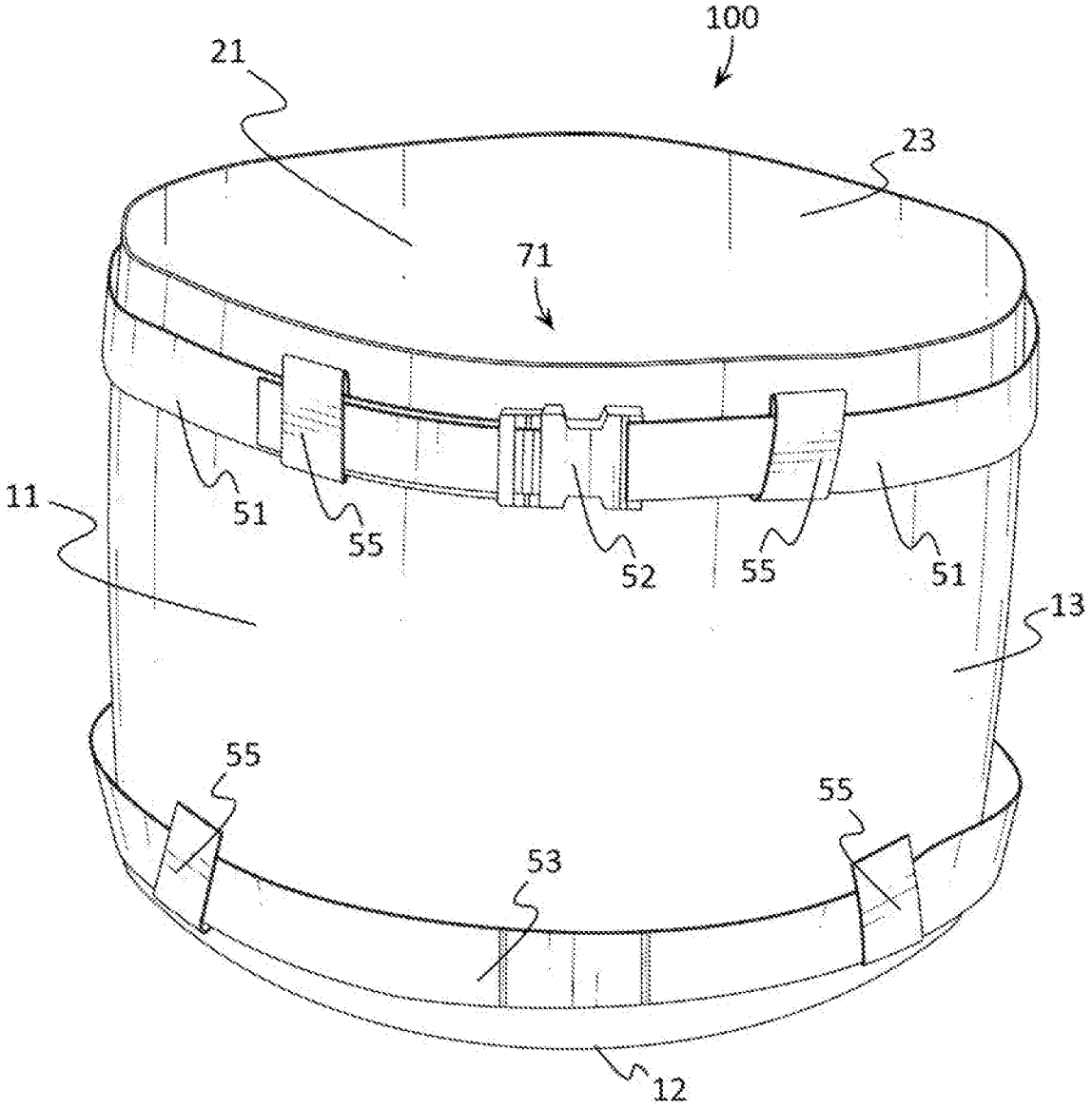
FIG. 1 depicts a front perspective view of an example of an appliance containment device according to various embodiments described herein.
Figure 2:
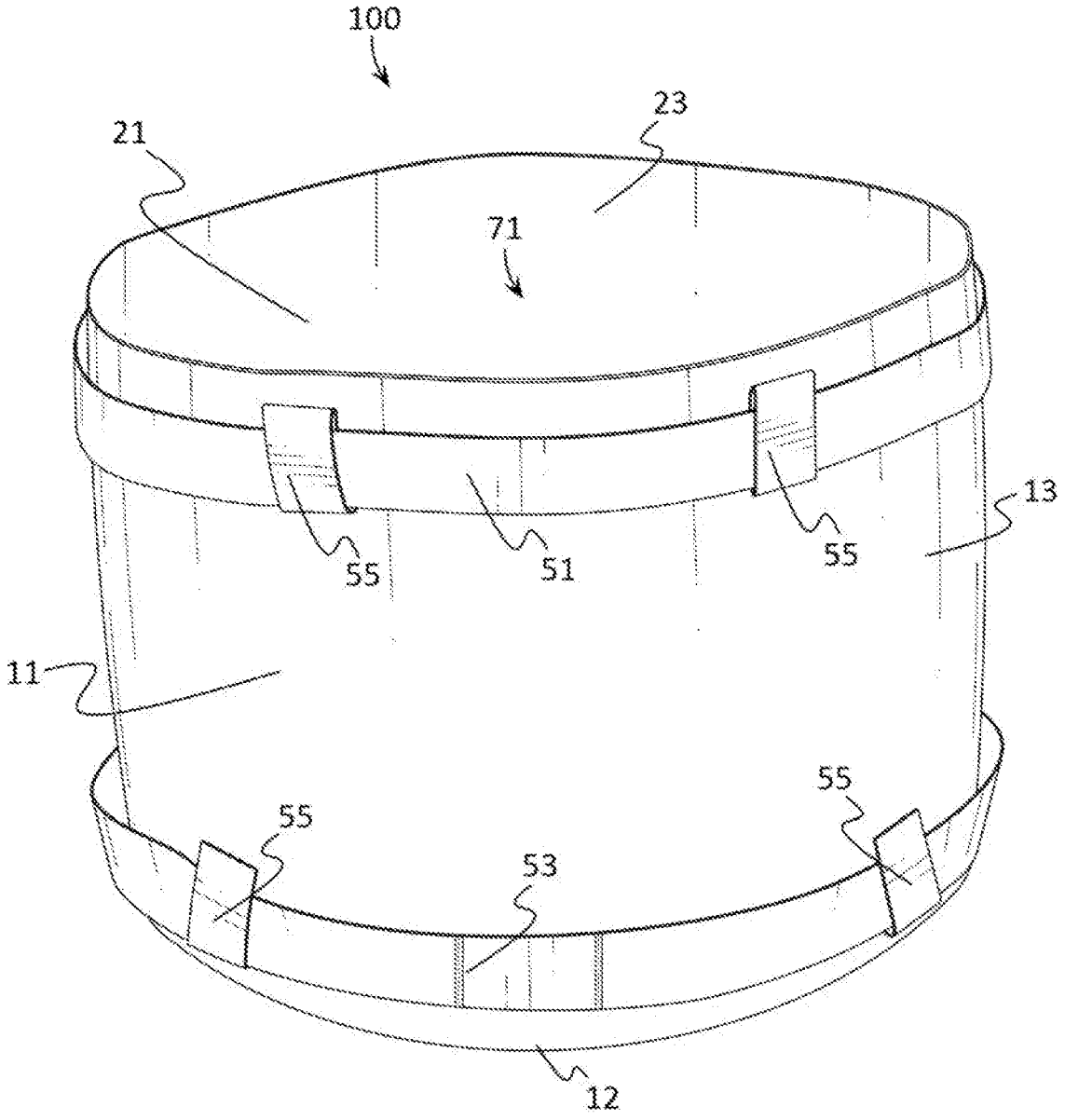
FIG. 2 illustrates a rear perspective view of an example of an appliance containment device according to various embodiments described herein.
Figure 3:
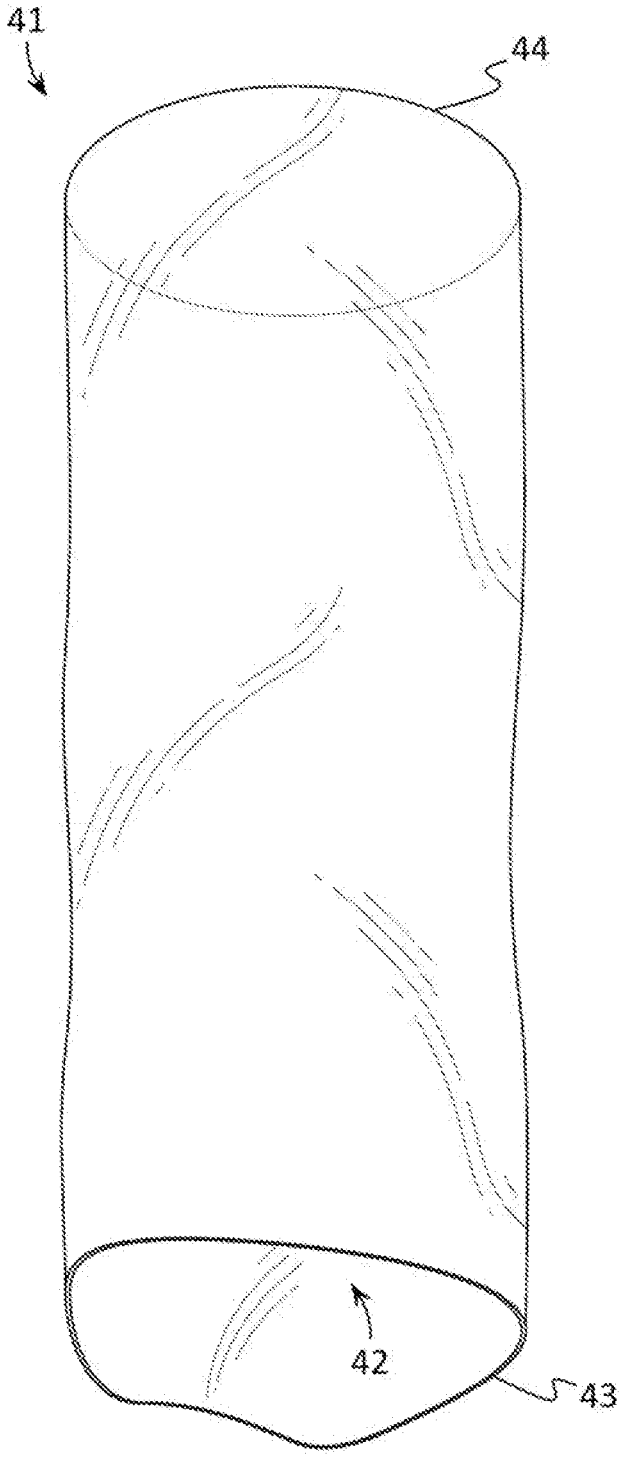
FIG. 3 shows a perspective view of an example of an encasement (made of a transparent material for illustration purposes) according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts of the invention. Hence, specific dimensions and other physical characteristics relating to the embodiments disclosed herein are not to be considered as limiting, unless expressly stated otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new appliance containment device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-5 illustrate examples of an appliance containment device ("the device") 100 according to various embodiments. In some embodiments, the device 100 may comprise a shell 11 having a shell floor 12 and a shell wall 13, and a cover 21 having a cover floor 22 and a cover wall 23. The cover wall 23 and shell wall 13 may be coupled together. A first mat 31 may be coupled to the cover floor 22. A container cavity 71 for receiving portions of an appliance 200, such as a water heater, may be formed above the cover floor 22 and shell floor 12, and the container cavity 71 may be bounded horizontally by the shell wall 13 and cover wall 23. Lower portions of an appliance 200 may be positioned in the container cavity 71. Optionally, the device 100 may comprise an encasement 41 which may be positioned around the upper portions of the appliance 200 with lower portions of the encasement 41 extending into the container cavity 71, thereby allowing the device 100 to encase the appliance 200 within the shell 11, cover 21, and encasement 41.

The device 100 may comprise one or more shells 11 which may be configured to function as an open container for receiving portions of an appliance 200. Generally, all or portions of a shell 11 may surround the container cavity 71. A shell 11 may comprise a shell floor 12 and one or more shell walls 13 which may be configured in any shape and size. In some embodiments, a shell wall 13 may be coupled to a shell floor 12 and/or to another shell wall 13 with stitching, such as which may be used to form a rolled seam, adhesive, heat bonding or heat welding, fasteners, such as rivets, while in other embodiments, any other suitable coupling method may be used. In alternative embodiments, a shell wall 13 may be coupled to a shell floor 12 by being integrally formed together.

In preferred embodiments, a shell 11 may comprise a generally circular shell floor 12 with a cylindrical shaped shell wall 13 coupled to and extending away from the shell floor 12. In this manner, a shell 11 may be generally configured as an open cylinder. In other embodiments, a shell 11 may comprise a generally rectangular shell floor 12 with four rectangular shaped shell walls 13 coupled together and coupled to and extending away from the shell floor 12. In this manner, a shell 11 may be generally configured as an open rectangular prism. In alternative embodiments, a shell 11 and its shell floor 12 and shell wall(s) 13 may be configured in any other size and shape.

The device 100 may comprise one or more covers 21 which may also be configured to function as an open container for receiving portions of an appliance 200. Generally, all or portions of a cover 21 may surround the container cavity 71. A cover 21 may comprise a cover floor 22 and one or more cover walls 23 which may be configured in any shape and size. In some embodiments, a cover wall 23 may be coupled to a cover floor 22 and/or to another cover wall 23 with stitching, such as which may be used to form a rolled seam, adhesive, heat bonding or heat welding, fasteners, such as rivets, while in other embodiments, any other suitable coupling method may be used. In alternative embodiments, a cover wall 23 may be coupled to a cover floor 22 by being integrally formed together.

In preferred embodiments, a cover 21 may comprise a generally circular cover floor 22 with a cylindrical shaped cover wall 23 coupled to and extending away from the cover floor 22. In this manner, a cover 21 may be generally configured as an open cylinder. In other embodiments, a cover 21 may comprise a generally rectangular cover floor 22 with four rectangular shaped cover walls 23 coupled together and coupled to and extending away from the cover floor 22. In this manner, a cover 21 may be generally configured as an open rectangular prism. In alternative embodiments, a cover 21 and its cover floor 22 and cover wall(s) 23 may be configured in any other size and shape.

In preferred embodiments, the device 100 may comprise a shell 11 and a cover 21 which may be approximately equal in size and shape (more preferably, the cover 21 may be slightly smaller than the shell 11), and the cover 21 may be positioned within the shell 11 so that the shell 11 and cover 21 may generally form a double walled, open container. Generally, a cover 21 may be positioned within the shell 11 so that the cover floor 22 is positioned above, and optionally in contact with, the shell floor 12, while the cover wall(s) 23 may be positioned proximate to, and optionally in contact with, the shell wall(s) 13. In alternative embodiments, a cover floor 22 may not extend along the entirety of the shell floor 12 and/or a cover wall 23 may not extend along the entirety of a shell wall 13.

In some embodiments, a shell 11 and/or a cover 21 may be made from or may comprise a flexible material that preferably may be puncture resistant and friction reducing, such as natural and/or synthetic fabrics including polystyrene poly backed fabric material, ripstop nylon, spun fiber fabrics, woven fiber fabrics, natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), thermoplastic elastomer material, other rubber and/or plastic type materials, or any other flexible material including combinations of materials. In still further embodiments, a shell 11 and/or a cover 21 may be formed or may comprise a molded thermoplastic elastomer material, other rubber and/or plastic type materials, or any other molded material.

Figure 5:
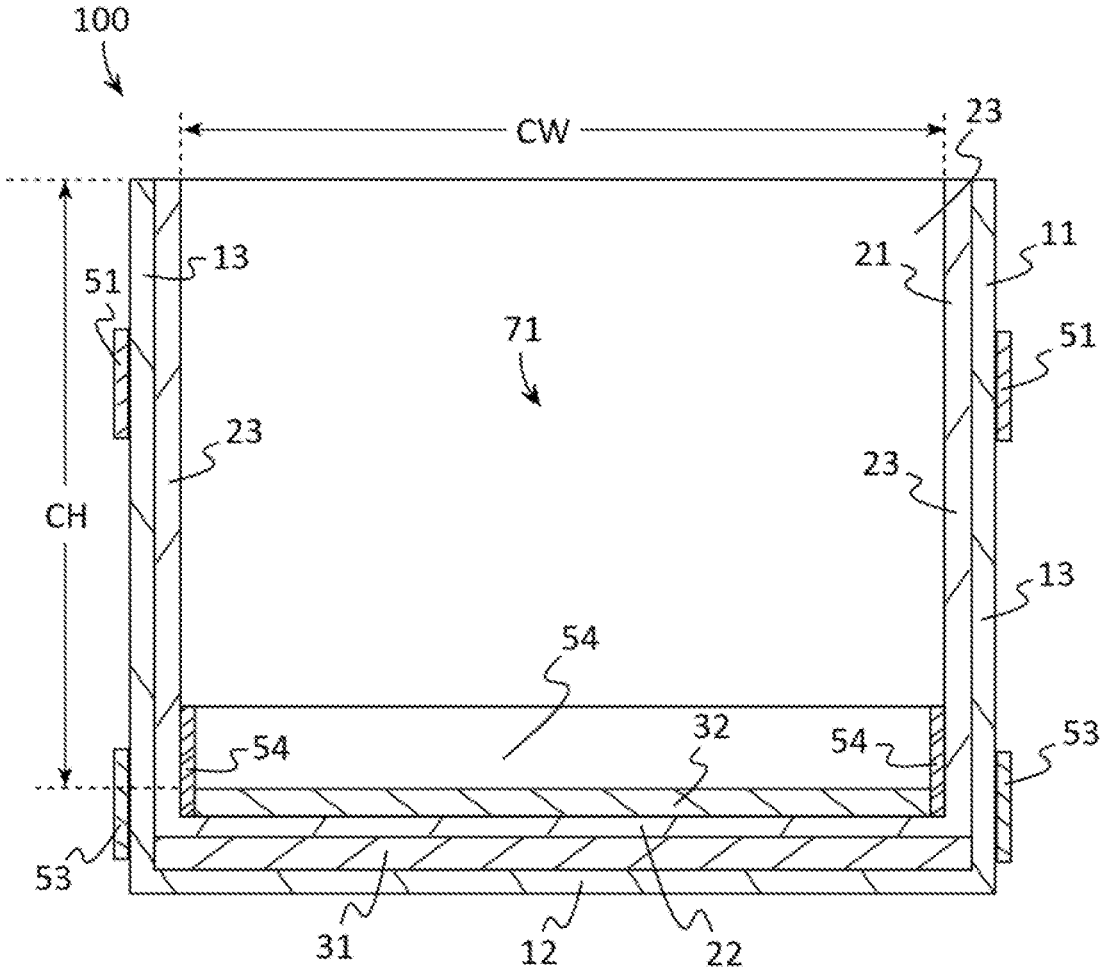
FIG. 5 shows a sectional, elevation view of another example of an appliance containment device according to various embodiments described herein.

A shell 11 and a cover 21 may be shaped and sized to form a container cavity 71 having a container height dimension (CH) and a container width dimension (CW) as shown in FIG. 5. In some embodiments, a container height dimension (CH) may be between approximately 5.0 to 60.0 inches, and more preferably between approximately 12.0 to 36.0 inches. In some embodiments, a container width dimension (CW) may be between approximately 20.0 to 60.0 inches, and more preferably between approximately 25.0 to 45.0 inches. In alternative embodiments, a container height dimension (CH) and a container width dimension (CW) may be configured in any other height dimension or width dimension.

Figure 12:
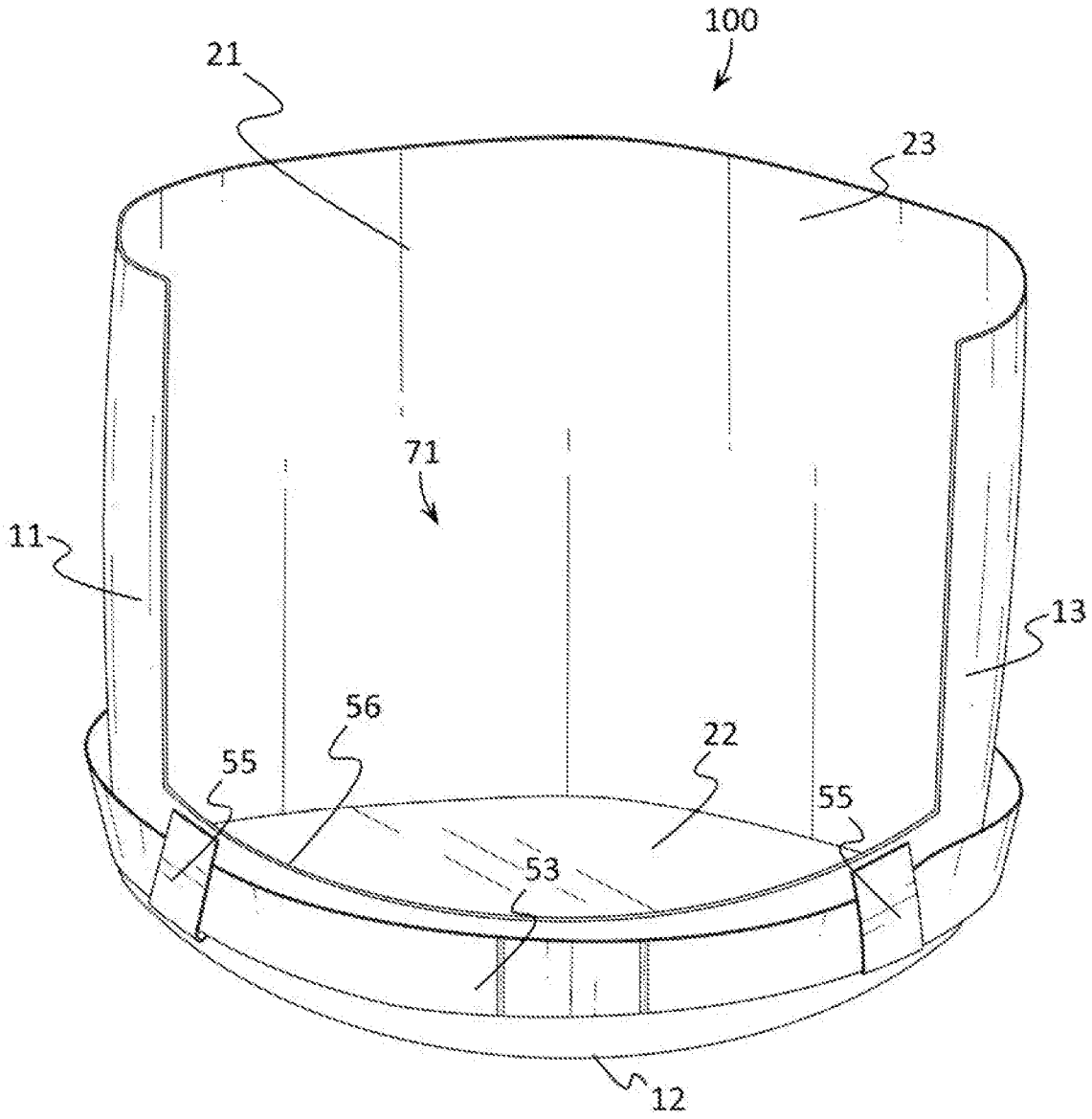
FIG. 12 depicts a front perspective view of still a further example of an appliance containment device according to various embodiments described herein.

In some embodiments, and as shown in FIG. 12, the device 100 may comprise a recess 56. Generally, a recess 56 may be formed in a shell wall 13, a cover wall 23, and/or a liner wall 63 so as to decrease the height of the shell wall 13, a cover wall 23, and/or a liner wall 63 thereby decreasing the height that an appliance 200 must be lifted or otherwise moved in order to position the appliance 200 within the container cavity 71. For example, a shell wall 13, a cover wall 23, and/or a liner wall 63 proximate to a recess 56 may extend approximately one to twelve inches, such as approximately four inches above the shell floor 12, cover floor 22, and/or liner floor 62, respectively. A recess 56 may be configured in any size and shape. In further embodiments, the device 100 may comprise two or more recesses 56.

In some embodiments, the device 100 may comprise an encasement 41. Generally, an encasement 41 may be configured as a flexible container for receiving all or portions of an appliance 200. In preferred embodiments, an encasement 41 may comprise a generally hollow cylindrical shape to form a generally cylindrically shaped encasement cavity 42. In other embodiments, an encasement 41 may comprise a generally hollow rectangular prism shape to form a generally rectangular prism shaped encasement cavity 42. In other embodiments, an encasement 41 and an encasement cavity 42 may be configured in any other shape.

An encasement 41 may comprise a first end 43 and a second end 44, and the first end 43 may be open and the second end 44 may be closed so that the second end 44 may rest on portions of an appliance 200 that is received in the encasement cavity 42. In this manner, portions of an appliance 200 may enter the encasement cavity 42 via the open first end 43 and may be prevented from exiting the encasement cavity 42 via the second end 44. The encasement 41 preferably may be shaped to allow the encasement cavity 42 to have a length of approximately 60 to 100 inches and a width of approximately 15 to 35 inches so that all or portions of an appliance 200, such as a water heater, may be received in the encasement cavity 42. In other embodiments, an encasement 41 and an encasement cavity 42 may be configured in any other size.

An encasement 41 may be made from or may comprise a generally flexible material that may be waterproof. In preferred embodiments, an encasement 41 may be made from or may comprise polymer sheeting, such as thin woven nylon or other fabric impregnated with liquid silicone (such as Silnylon), Polypropylene (PP), Medium Density Polyethylene (MDPE), Linear Low Density Polyethylene (LLDPE), Low Density Polyethylene (LDPE), High Density Polyethylene (HDPE), any other polyethylene, Polyvinyl chloride, or any other flexible polymer material that may be waterproof. In further embodiments, an encasement 41 may be made from or may comprise a laminate of woven and sheet polyethylene material, canvas, Waterproof Ripstop Nylon cloth that has been made waterproof by applying silicone on both sides of the fabric, and/or any other flexible material.

In some embodiments, the device 100 may comprise one or more mats, such as a first mat 31 and a second mat 32. A mat 31, 32, may be made of or may comprise a puncture resistant material, which may include natural and/or synthetic rubber material, including recycled rubber, such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other material including combinations of materials. Preferably, a mat 31, 32, may be made of a flexible material which may allow the mat 31, 32, to resist permanent deformation.

Figure 4A:
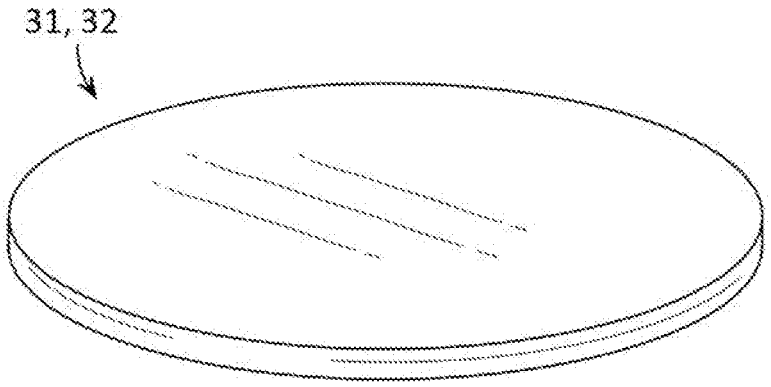
FIG. 4A depicts a perspective view of an example of a mat according to various embodiments described herein.
Figure 4B:
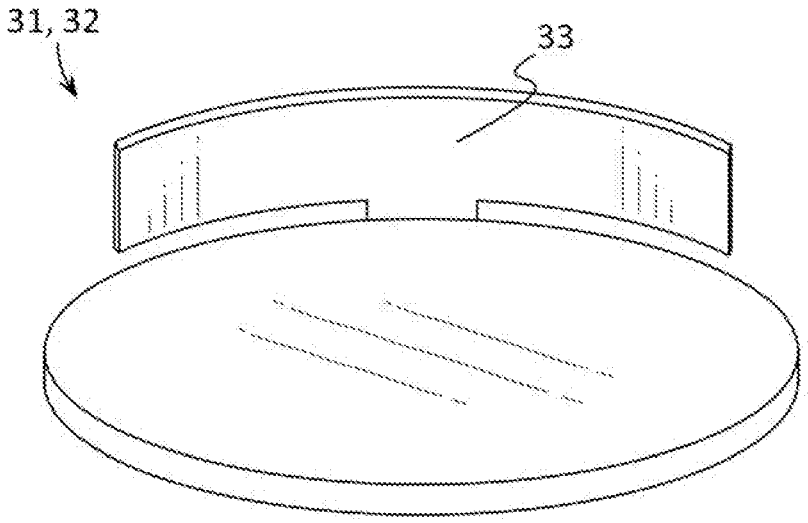
FIG. 4B illustrates a perspective view of another example of a mat according to various embodiments described herein.

A mat 31, 32, may be configured in any shape and size. Preferably, a mat 31, 32, may be shaped and sized to extend across portions of an appliance 200 that may be received in the container cavity 71 in order to prevent the appliance 200 from contacting a cover floor 22 and/or shell floor 12. In some embodiments, and as shown in FIG. 4A, a mat 31, 32, may comprise a generally disc shape or flattened cylindrical shape. In other embodiments, and as shown in FIG. 4B, a mat 31, 32, may comprise a generally disc shape or flattened cylindrical shape, and the mat 31, 32, may also comprise a mat extension 33 which may be configured to be positioned between portions of an appliance 200 received in the container cavity 71 and a cover wall 23 and/or a shell wall 13.

In preferred embodiments, a mat 31, 32, may be positioned so that the mat 31, 32, is in contact with portions of a cover floor 22 and/or shell floor 12. In some embodiments, a mat 31, 32, may be coupled to a cover floor 22 and/or shell floor 12. In further embodiments, a mat 31, 32, may be coupled between a cover floor 22 and a shell floor 12. In still further embodiments, a mat 31, 32, may be removably positioned within the container cavity 71 in contact with portions of a cover floor 22 and/or shell floor 12.

Figure 6:
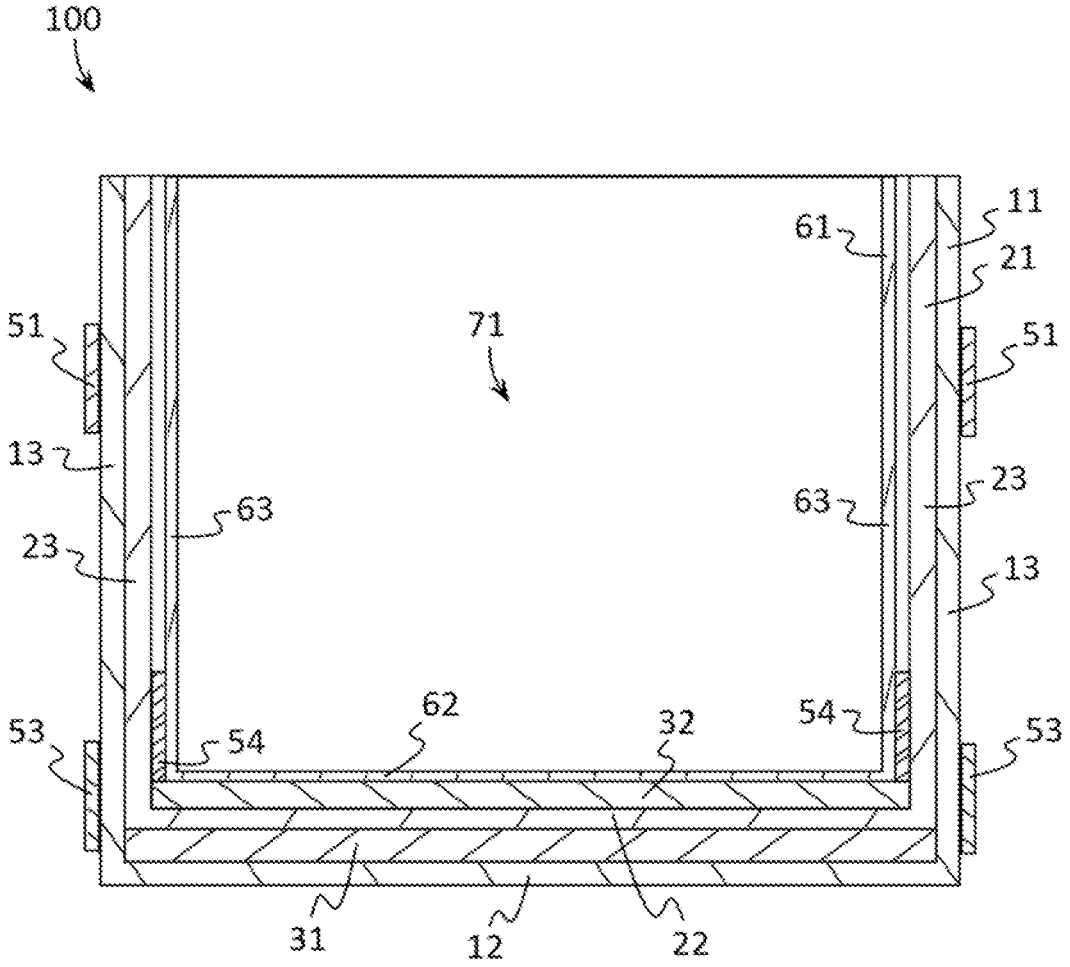
FIG. 6 depicts a sectional, elevation view of yet another example of an appliance containment device according to various embodiments described herein.
Figure 7:
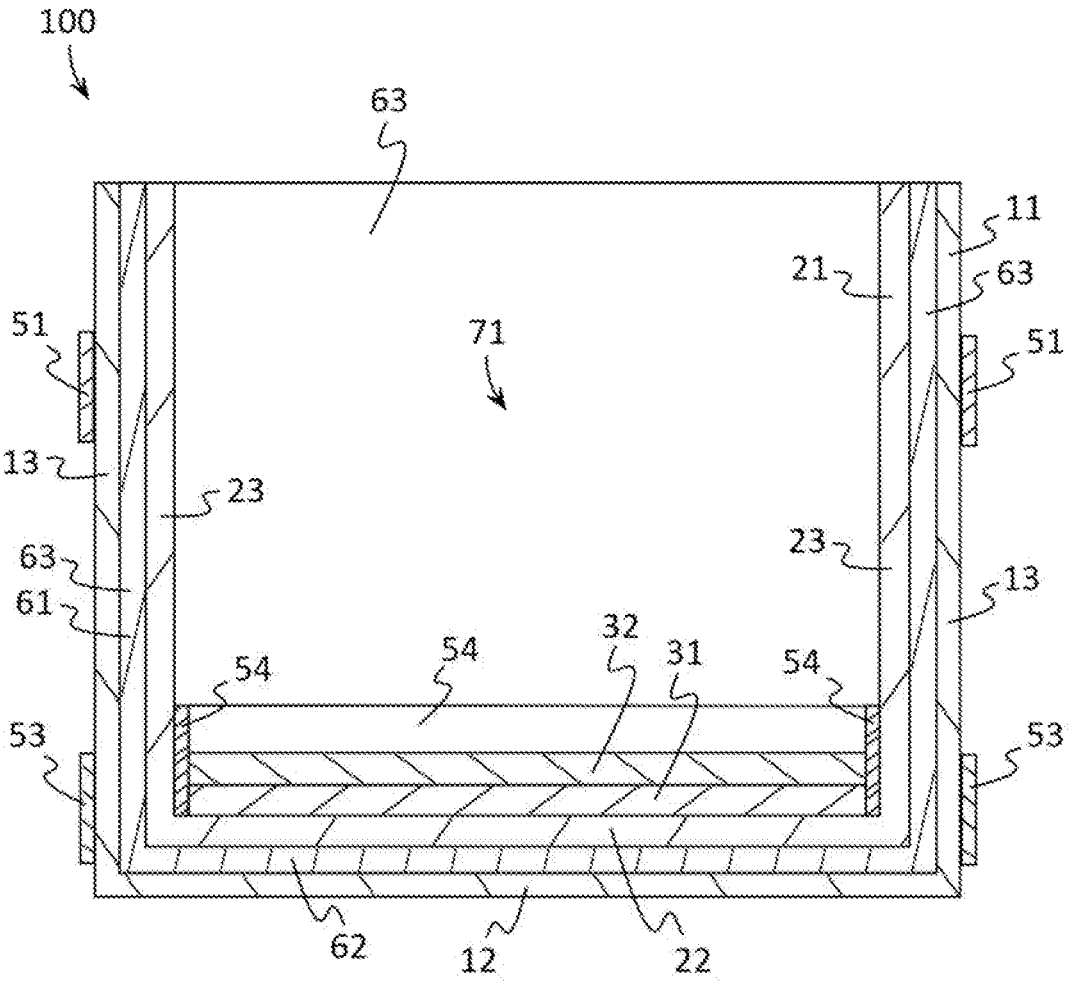
FIG. 7 illustrates a sectional, elevation view of still another example of an appliance containment device according to various embodiments described herein.

In some embodiments, the device 100 may comprise a first mat 31 that may be positioned between the shell floor 12 and cover floor 22 as shown in FIGS. 5 and 6. In further embodiments, the device 100 may comprise a second mat 32 which may be positioned in the container cavity 71 so that the first mat 31 and second mat 32 are positioned on opposing sides of the cover floor 22 as shown in FIGS. 5 and 6. In other embodiments, the device 100 may comprise a first mat 31 that may be positioned in contact with the cover floor 22 so that the first mat 31 and shell floor 12 are on opposing sides of the cover floor 22 as shown in FIG. 7. In further embodiments, the device 100 may comprise a second mat 32 which may be positioned in contact with the first mat 31 so that the second mat 32 and cover floor 22 may be positioned on opposing sides of the first mat 31 as shown in FIG. 7.

In some embodiments, the device 100 may comprise a retainer 51 which may be configured to secure the device 100 to an appliance 200. Preferably, a retainer 51 may be configured to frictionally secure the device 100 to an appliance 200, such as by cinching or otherwise decreasing the size of the walls 13, 23. Alternatively, a retainer 51 may be configured to couple to an appliance 200 via a magnetic attraction, such as by the retainer 51 comprising a magnetic material, via an adhesive, via a fastener, such as a carabiner, hook, etc., or any other coupling method. A retainer 51 may be coupled to a shell wall 13, cover wall 23, or any other element of a shell 11 and/or cover 21.

In preferred embodiments, a retainer 51 may be made from a length of flexible material, such as cord, rope, nylon webbing, leather strap, or the like, which may be positioned around the shell wall 13 and which may be movably coupled to the shell wall 13 so that the length of retainer 51 in contact with the shell wall 13 may be increased and decreased. By increasing the length of retainer 51 in contact with the shell wall 13, the size of the shell wall 13 and cover wall 23 may be increased or disposed at its maximum. Conversely, by decreasing the length of retainer 51 in contact with the shell wall 13, the size of the shell wall 13 and cover wall 23 may be decreased in order to tighten or cinch the shell wall 13 and cover wall 23 around portions of an appliance 200 received in the container cavity 71. For example, a retainer 51 may be movably coupled to a shell wall 13 via one or more slide loops 55 which may comprise a length of material that may be stitched or otherwise coupled to the shell wall 13 so that portions of the retainer 51 may slide behind the slide loops 55.

In further preferred embodiments, a retainer 51 may comprise a fastener 52 which may be used to control the length of retainer 51 in contact with the shell wall 13. For example, a retainer 51 may comprise one or more side release buckles, buckles, clasps, slides, loops, reducers, cam buckles, strap adjusters, snap hooks, D rings, tri-loops, footman loops, keepers, cord locks, strap locks, or any other suitable means for adjusting the length of the retainer 51 in order to increase, maintain, and decrease the length of retainer 51 in contact with the shell wall 13.

In some embodiments, the device 100 may comprise a handle 53 which may be gripped or otherwise manipulated by a user 300 to facilitate moving the device 100 and an appliance 200 received by the device 100. A handle 53 may be coupled to a shell wall 13, cover wall 23, or any other element of a shell 11 and/or cover 21 with any suitable coupling method. For example, a handle 53 may be coupled to a shell wall 13 via one or more slide loops 55 which may comprise a length of material that may be stitched or otherwise used to couple (optionally movably couple) a portion of the handle 53 to the shell wall 13. In preferred embodiments, a handle 53 may be coupled to a shell wall 13 and/or cover wall 23 so that the handle 53 is positioned relatively farther from the floors 12, 22, than a retainer 51 that may be coupled to a shell wall 13 and/or cover wall 23.

Figure 13:
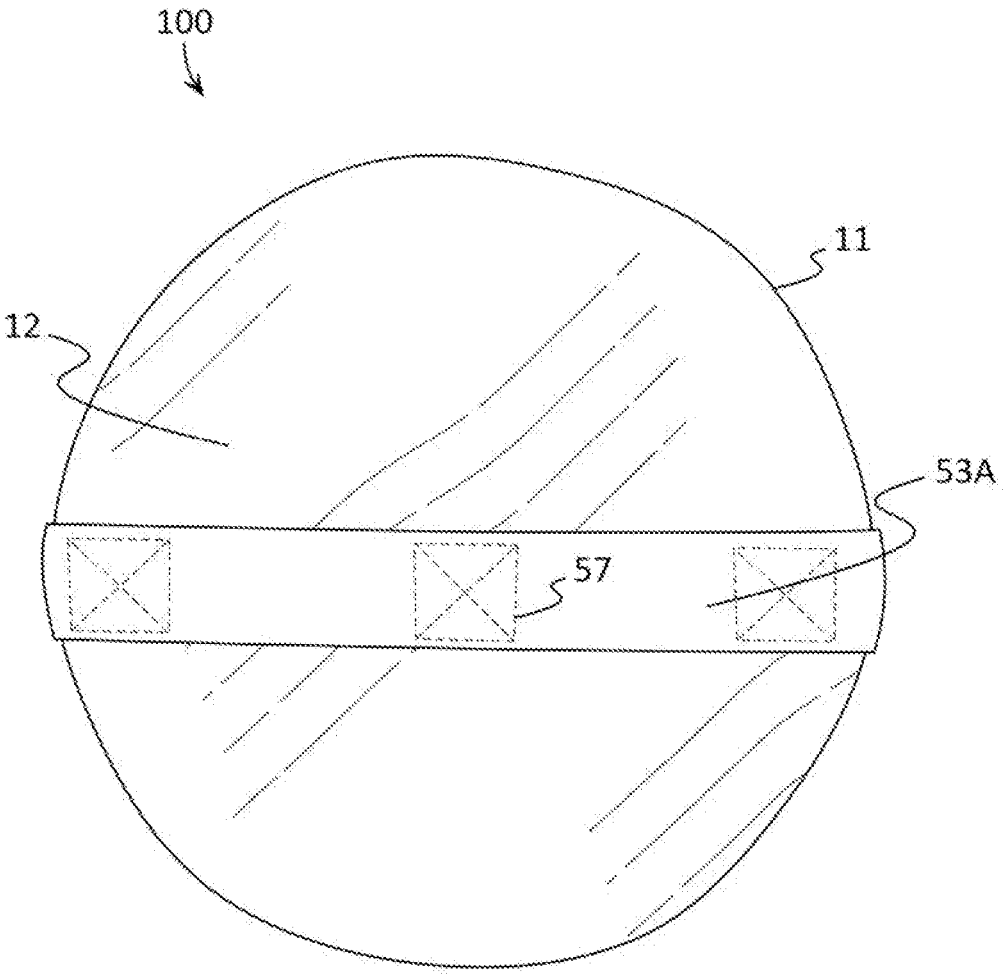
FIG. 13 illustrates a bottom plan view of an example of an appliance containment device according to various embodiments described herein.

In some embodiments, the device may comprise a lower handle 53A which may extend across all or portions of the bottom or exterior surface 12A of the shell floor 12 as perhaps best shown in FIG. 13. A handle 53, 53A, may be coupled to the shell 11 or any other element described herein with stitching 57 or any other suitable coupling method. In preferred embodiments, a handle 53, 55A, may be made from a length of flexible material, such as cord, rope, nylon webbing, leather strap, or the like, which may be positioned around the shell wall 13 and/or shell floor 12 and which may be coupled to the shell floor 12, shell wall 13, and/or cover wall 23. In further embodiments, a handle 53, 55A, may comprise a substantially rigid material such as hard plastics, metal, and metal alloys, fiberglass, ceramics, resins, wood, hard rubber, or any other material suitable for use as a handle for grasping and facilitating the movement of the device 100 and an appliance 200 received by the device 100.

In some embodiments, the device 100 may comprise one or more buttresses 54. Generally, a buttress 54 may comprise a portion of material which may be coupled to a shell wall 13 and/or cover wall 23. In preferred embodiments, a buttress 54 may comprise a portion of material which may be coupled to a cover wall 23 proximate to or in contact with a cover floor 22 and/or one or more mats 31, 32. Optionally, a buttress 54 may comprise a portion of material which may extend around the entire length of a cover wall 23 proximate to or in contact with a cover floor 22 and/or one or more mats 31, 32. In preferred embodiments, a buttress 54 may be made from a length of flexible material, such as cord, rope, nylon webbing, leather strap, or the like, which may be positioned around the shell wall 13 and which may be coupled to the shell wall 13 and/or cover wall 23. In other embodiments, a buttress 54 may be made from a length of flexible material, such as which may be used to form all or portions of the floors 12, 22, and/or walls 13, 23.

In some embodiments, the device 100 may comprise one or more liners 61 which may be configured to extend across or contact all or portions of one or more floors 12, 22, and/or walls 13, 23. Generally, a liner 61 may comprise a water proof material which may prevent liquids that may leak out of an appliance 200 that is received in the container cavity 71 from seeping or leaking through one or more floors 12, 22, and/or walls 13, 23. A liner 61 may comprise a liner floor 62 and one or more liner walls 63 which may be configured in any shape and size. In preferred embodiments, a liner 61 may comprise a flexible water proof sheet material, such as such as high-density polyethylene (HDPE), polyvinyl chloride (PVC), polypropylene (PP), Polystyrene (PS), Polycarbonate (PC), low density polyethylene (LDPE), and the liner floor 62 liner wall(s) 63 may be integrally formed together. In other embodiments, a liner 61 may comprise any other substantially flexible or rigid material which may be water and/or other liquid impermeable.

In some embodiments, and as shown in FIGS. 5 and 6, a liner 61 may be positioned within the container cavity 71 so that the liner 61 may be positioned between all or portions of the cover 21 and an appliance 200 that is received in the container cavity 71. In further embodiments, a liner 61 may be removably coupled to all or portions of one or more floors 12, 22, and/or walls 13, 23. For example, a liner 61 may be removably coupled to the cover floor 22 and cover wall(s) 23 of the cover 21 via hook-and-loop type fasteners, press fit fasteners, or any other coupling method so that the liner 61 may be removed or replaced as needed. In other embodiments, a liner 61 may be simply placed in the container cavity 71 and held in position via friction and/or gravity.

In some embodiments, and as shown in FIG. 7, a liner 61 may be positioned between portions of the cover 21 and the shell 11. In preferred embodiments, a liner 61 may be positioned between portions of the cover 21 and the shell 11 so that the liner 61 may generally separate all or portions of the shell floor 12 and cover floor 22 from each other and/or separate all or portions of the shell wall(s) 13 and cover wall(s) 23 from each other.

Figure 8:
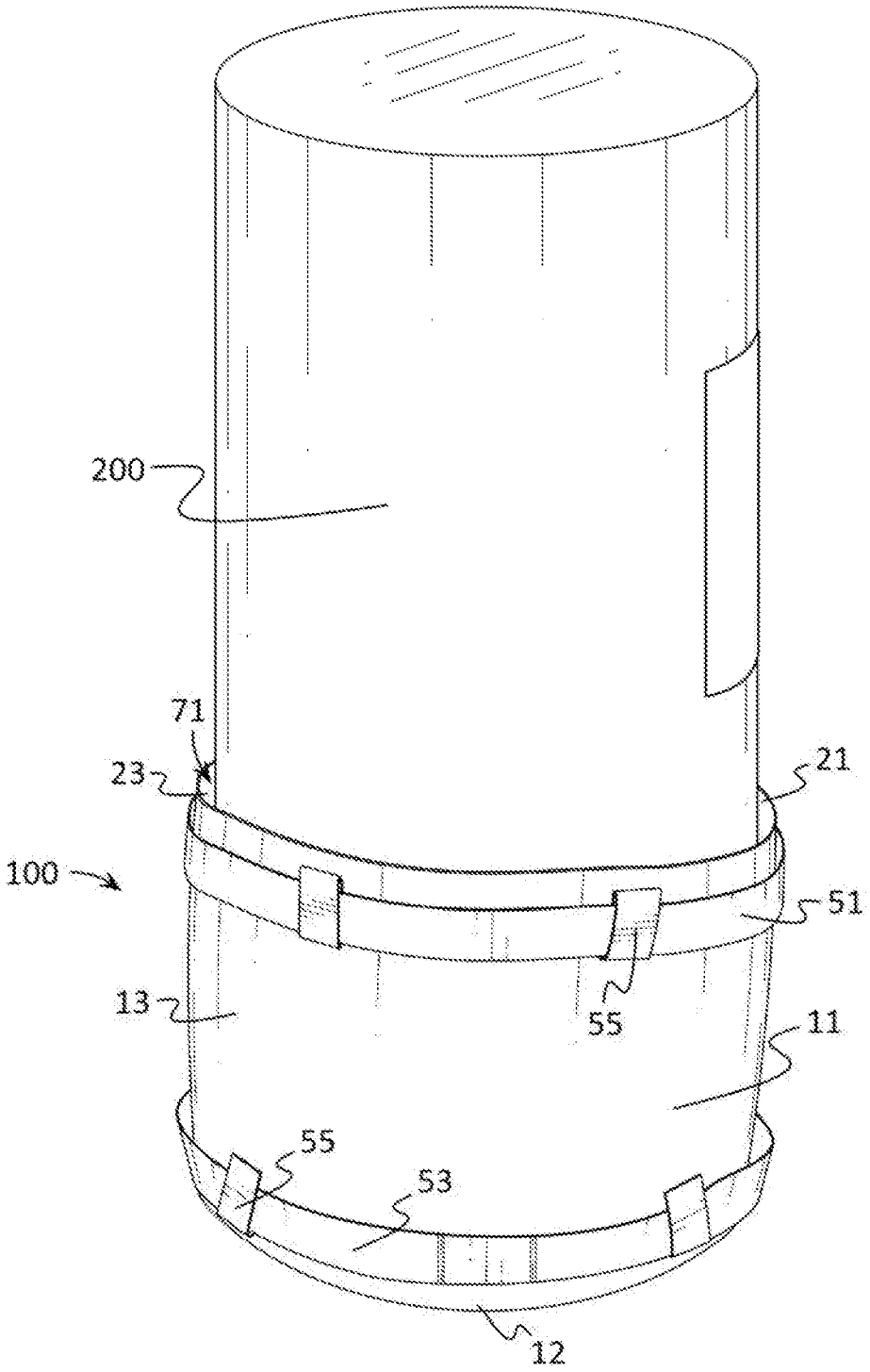
FIG. 8 shows a perspective view of an example appliance received in a container cavity of an exemplary appliance containment device according to various embodiments described herein.
Figure 9:
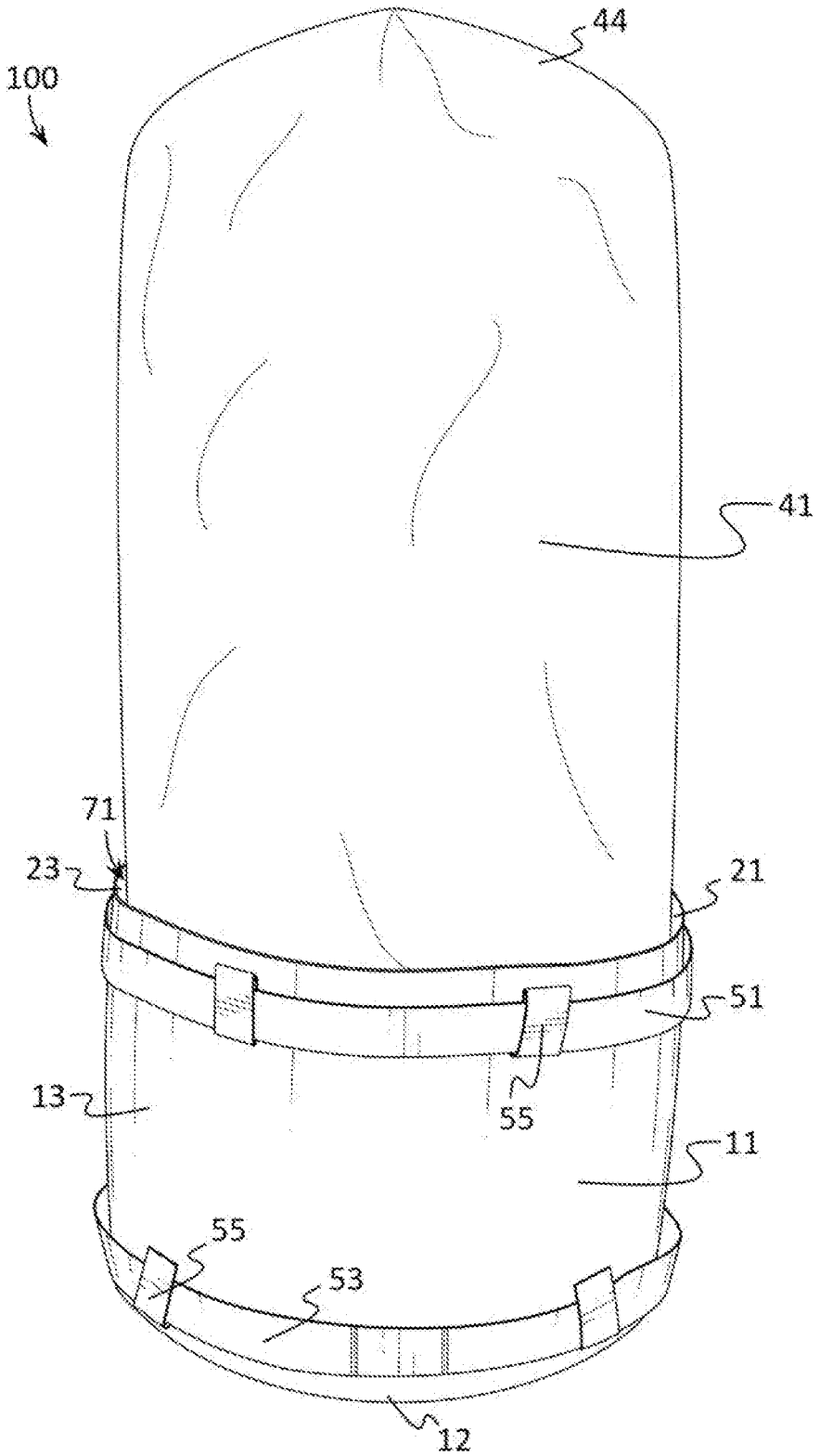
FIG. 9 depicts a perspective view of an example appliance received in a container cavity and an encasement cavity of an exemplary appliance containment device according to various embodiments described herein.
Figure 10:
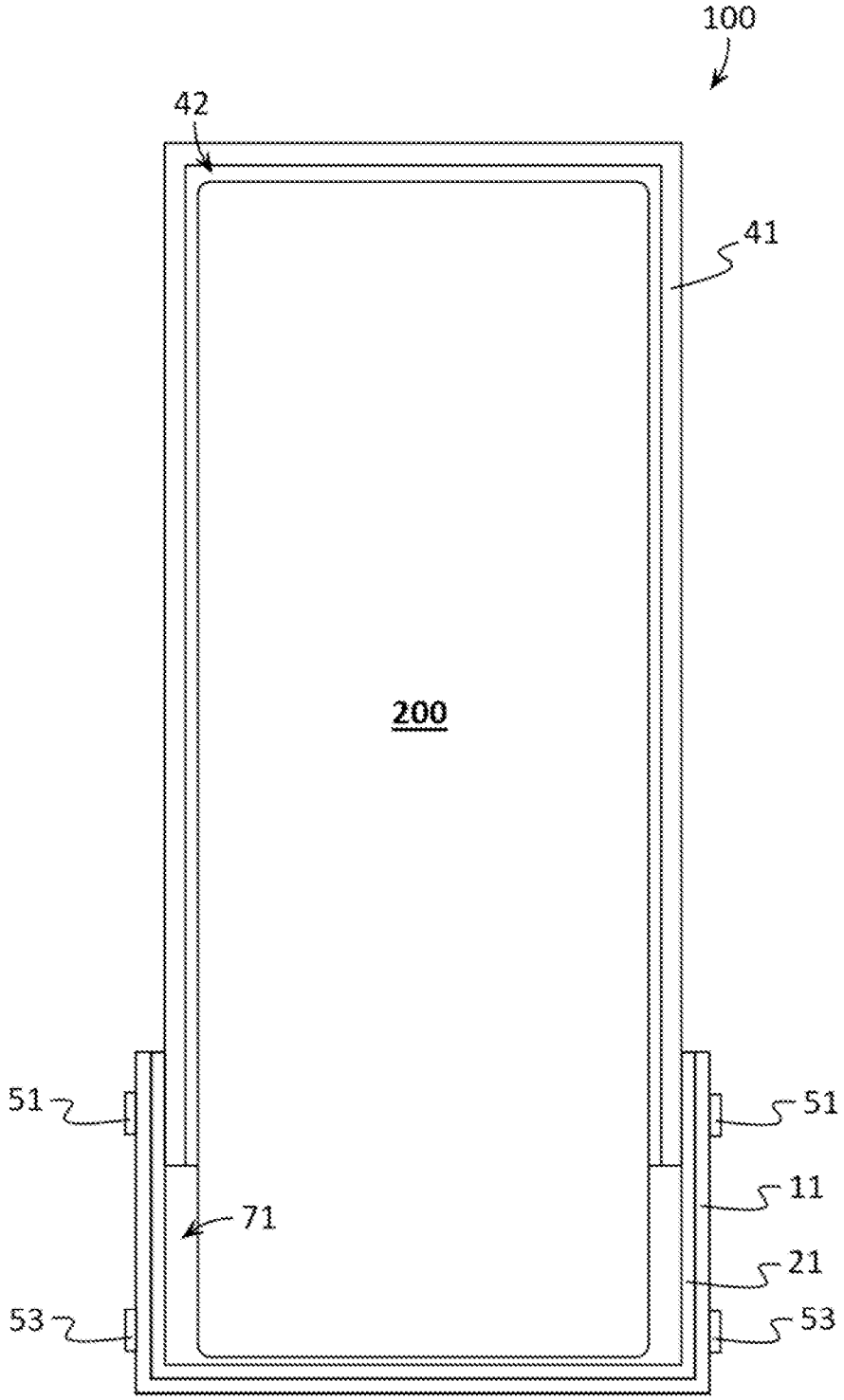
FIG. 10 illustrates a block diagram of an example appliance received in a container cavity and an encasement cavity of an exemplary appliance containment device according to various embodiments described herein.
Figure 11:
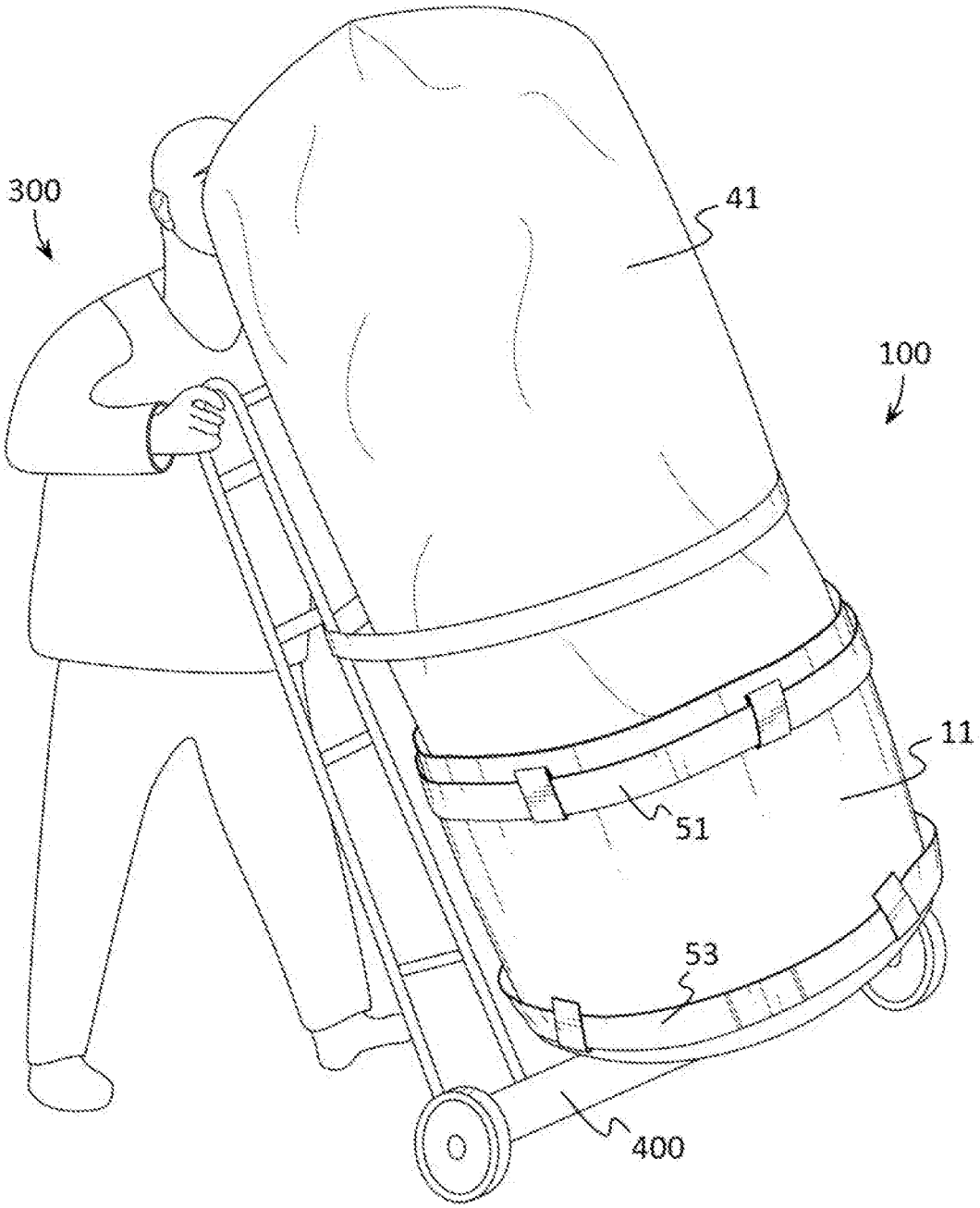
FIG. 11 shows a perspective view of an example appliance received in a container cavity and an encasement cavity of an exemplary appliance containment device being moved by a user via a hand truck according to various embodiments described herein.

As perhaps best shown in FIGS. 8-11, the device 100 may be used to facilitate the transportation of an appliance 200, such as a water heater. Preferably, lower portions of an appliance 200 may be positioned in the container cavity 71 (FIG. 8). For example, a user 300 may lay the appliance 200 on its side, optionally on a hand truck 400, and then the user 300 may position the shell 11 and cover 21 over the appliance 200 so that the lower portions of the appliance 200 may be positioned in the container cavity 71. The user 300 may then right the appliance 200 and position the encasement 41 over the appliance 200 so that portions of the appliance 200 are positioned in the encasement cavity 42. Preferably, the first end 43 may be positioned in the container cavity 71 between the appliance 200 and the walls 13, 23. A retainer 51 may then be utilized to secure the shell 11, cover 21, and first end 43 to the appliance 200, preferably by tensioning the retainer 51 so that the shell 11, cover 21, and first end 43 are frictionally coupled to the appliance 200 (FIGS. 9 and 10). The appliance 200 and device 100 may then be moved as desired by the user 300, preferably via a hand truck 400 or the like (FIG. 11). Additionally, a user 300 may grasp a handle 53 to further facilitate moving and positioning the appliance 200 and device 100.

While some exemplary shapes and sizes have been provided for elements of the device 100, it should be understood to one of ordinary skill in the art that the shell 11, cover 21, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An appliance containment device, the device comprising:

a shell having a shell floor and a shell wall with a shell wall height;

a cover having a cover floor and a cover wall with a cover wall height, the cover wall and shell wall coupled together;

a recess formed respectively into an area of the shell wall and the cover wall, the recess decreasing a portion of both the shell wall height and the cover wall height;

a first mat in contact with the cover floor; and a container cavity for receiving portions of an appliance, the container cavity formed above the cover floor and shell floor, and the container cavity bounded horizontally by the shell wall and cover wall but not by the recess; and wherein the recess is configured as to reduce a lifting height that an appliance must be lifted in order to position the appliance within the container cavity.

2. The device of claim 1, wherein the first mat is positioned between the shell floor and cover floor.

3. The device of claim 1, further comprising a handle that is movably coupled to the shell wall, wherein portions of the handle are positioned below the recess.

4. The device of claim 1, wherein the first mat comprises a mat extension that extends above the shell floor and cover floor.

5. The device of claim 1, further comprising a container width dimension (CW), wherein the recess extends greater than 25 percent and less than 100% of the container width dimension (CW).

6. The device of claim 1, further comprising a second mat positioned in the container cavity so that the first mat and second mat are positioned on opposing sides of the cover floor.

7. The device of claim 1, further comprising a buttress, the buttress positioned within the container cavity and coupled to the cover wall, and the buttress comprising a flexible material.

8. The device of claim 1, further comprising a liner.

9. The device of claim 8, wherein the liner is positioned in the container cavity.

10. The device of claim 8, wherein the liner is positioned between the cover and the shell.

11. The device of claim 1, further comprising an encasement.

12. An appliance containment device, the device comprising:

a shell having a shell floor and a shell wall with a shell wall height, the shell comprising a flexible material;

a cover having a cover floor and a cover wall with a cover wall height, the cover wall and shell wall coupled together, and the cover comprising a flexible material;

a recess formed respectively into an area of the shell wall and the cover wall, the recess decreasing a portion of both the shell wall height and the cover wall height;

a handle movably coupled to the shell wall, wherein portions of the handle are positioned below the recess;

a first mat comprising a flexible material positioned between the shell floor and cover floor, the first mat having a mat extension that extends above the shell floor and cover floor; and a container cavity for receiving portions of an appliance, the container cavity formed above the cover floor and shell floor, and the container cavity bounded horizontally by the shell wall and cover wall but not by the recess; and wherein the recess is configured as to reduce a lifting height that an appliance must be lifted in order to position the appliance within the container cavity.

13. The device of claim 12, further comprising a container width dimension (CW), wherein the recess extends greater than 25 percent of the container width dimension (CW).

14. The device of claim 12, further comprising a recess.

15. The device of claim 12, further comprising a second mat positioned in the container cavity so that the first mat and second mat are positioned on opposing sides of the cover floor.

16. The device of claim 12, further comprising a buttress, the buttress positioned within the container cavity and coupled to the cover wall, and the buttress comprising a flexible material.

17. The device of claim 12, further comprising a liner.

18. The device of claim 17, wherein the liner is positioned in the container cavity.

19. The device of claim 17, wherein the liner is positioned between the cover and the shell.

20. The device of claim 12, further comprising an encasement.

* * * * *